United States Patent [19]

Woodward

[11] Patent Number: 5,040,196

[45] Date of Patent: Aug. 13, 1991

[54] STACK COUNTING INSTRUMENT

[76] Inventor: William H. Woodward, 2 Sansome Close, Hackleton, Northampton, United Kingdom

[21] Appl. No.: 473,975

[22] PCT Filed: Oct. 20, 1988

[86] PCT No.: PCT/GB88/00888

§ 371 Date: Apr. 16, 1990

§ 102(e) Date: Apr. 16, 1990

[87] PCT Pub. No.: WO89/04021

PCT Pub. Date: May 5, 1989

[30] Foreign Application Priority Data

Oct. 20, 1987 [GB] United Kingdom ..... 8724506

[51] Int. Cl.[5] ..... G06M 9/00

[52] U.S. Cl. ..... 377/8; 377/3

[58] Field of Search ..... 372/3, 8

[56] References Cited

U.S. PATENT DOCUMENTS

| | | | |
|---|---|---|---|
| 3,813,523 | 5/1974 | Mohan et al. | 377/8 |
| 3,835,306 | 9/1974 | Bills et al. | 377/8 |
| 3,971,918 | 7/1976 | Saito | 377/8 |
| 4,225,931 | 9/1980 | Schwefel | 377/3 |
| 4,298,790 | 11/1981 | Decker et al. | 377/8 |
| 4,324,195 | 5/1983 | Nosler | 327/8 |
| 4,442,532 | 4/1984 | Takemura | 377/3 |

*Primary Examiner*—John S. Heyman

*Attorney, Agent, or Firm*—Edwin D. Schindler

[57] ABSTRACT

An instrument for counting the number of elements in a stack is moved over the side of the stack and an image of a portion (S) of the stack is formed on a linear photocell array(16). The photocell array is continually scanned and its electrical scan output signal is fed to a correlator which carries out an auto-correlation function while the instrument is initially stationary, and then a cross-correlation function as the instrument is moved, to furnish a time varying signal having a characteristic periodicity representing successive elements in the stack. The repeating cycles in this signal are counted to provide a count of the number of elements in the stack.

6 Claims, 2 Drawing Sheets

STACK COUNTING INSTRUMENT

This invention relates to an instrument for counting the number of sheets, panels or other elements in a stack.

There are various applications in which it is desirable to determine the number of sheets or panels in a stack of such elements. One example is for stock taking, another is for checking that the correct number of elements are delivered by a supplier to a customer. Manually counting the number of elements in a stack is time consuming and measuring the height of the stack does not necessarily yield an accurate indication of the number of elements in the stack.

A stack counting apparatus is disclosed in U.S. Pat. No. 4 298 790, in which apparatus a wheeled carriage moves along a track adjacent the stack and a photodetector on the carriage receives light reflected from the edges of the elements in the stack. The signal derived from the photocell is processed in conjunction with a train of pulses produced by an encoder coupled to an axle of the wheeled carriage, so that these pulses are synchronised with the movement of the carriage. Further, the signal processing system requires preprogramming with data representing the nominal thickness of the elements in the stack. The apparatus is therefore complex and requires a signal produced in synchronism with the travel of the carriage on which the photodetector is mounted, and requires information as to the nominal thickness of the elements in the stack.

A stack counting apparatus is also disclosed in European application No. 0 098 320, in which a photodetector is moved at a fixed velocity relative to the stack. The effective width of the photodetector must be adjusted in accordance with the thickness of the elements in the stack. The signal from the photodector is processed using a tapped analog delay line, so that the single photodector operates as the equivalent of a plurality of sensors spaced apart on the direction of its movement. The delay line requires a clock input the frequency of which is derived from a signal representing the fixed velocity of movement of the photodector relative to the stack. This apparatus also has the drawback of requiring a fixed velocity of movement which the processing circuit must know, and of requiring adjustment to match the thickness of the elements in the stack.

I have now devised an instrument which will provide an accurate count of the number of sheets, panels or other elements in a stack, whilst overcoming the drawbacks of the prior art apparatus.

In accordance with this invention there is provided an instrument for counting the number of elements in a stack, comprising means for scanning a side of the stack in a direction generally perpendicular to the edges of the elements in the stack to provide an electrical signal, and means for processing the electrical signal alone to determine a characteristic periodicity therein representing successive elements in the stack, and further counting the repeating cycles in said electrical signal to provide a count of the number of elements in said stack.

The instrument is preferably hand-held and arranged to be moved over the height of the stack whilst it repeatedly scans the portion of the stack which it is aligned with at each instant. The instrument preferably comprises an opto-electronic device such as a CCD (charge-coupled device) arranged to electronically scan an optical image projected onto it from the side of the stack. Preferably the instrument includes a light source for illuminating the portion of the stack with which it is aligned.

Preferably the instrument includes a digital read-out giving a count of the elements in the stack. In use, the instrument may be directed at for example the foot of the stack and the counter reset to zero, then moved up to the top of the stack. The read-out will give a count of the total number of elements in the stack. The instrument can also be used to count off a required number of elements from the top of the stack and for this purpose preferably the light source is arranged to project a datum line onto the side of the stack.

The signal analysing means may be arranged to determine a characteristic periodicity in the electrical signal from the scanning means, even if some of the individual elements are inset from the side of the stack and thus interrupt the regular variations in reflectance from the side of the stack over its height. The signal analysing means is thus able to determine the characteristic periodicity providing the majority of elements are exhibiting the expected reflectance.

In the preferred embodiment, the instrument comprises a linear photocell array and an optical system for forming an image of a portion of the side of the stack onto the photocell array. Successive electrical scan signals are read out from the photocell array and fed to a correlator device. Initially the instrument is held stationary against the stack and the correlator carries out an auto-correlation function to determine a set of master coefficients. Then when the instrument is moved over the side of the stack, the correlator performs a cross-correlation function on the successive scans with the set of master coefficients, to furnish a time varying signal having the characterstic periodicity representing the successive elements in the stack.

The instrument in accordance with the invention is simple and reliable to use and can be scanned at any speed, which may be variable, over the side of the stack. There is no need to move the instrument at constant speed, nor to control the signal processing in synchronism with the speed of movement, nor to know the thickness of the panels. Indeed, the instrument in accordance with the invention may itself determine the thickness of the panels.

An embodiment of this invention will now be described by way of example only and with reference to the accompanying drawings, in which.

Figure 1:
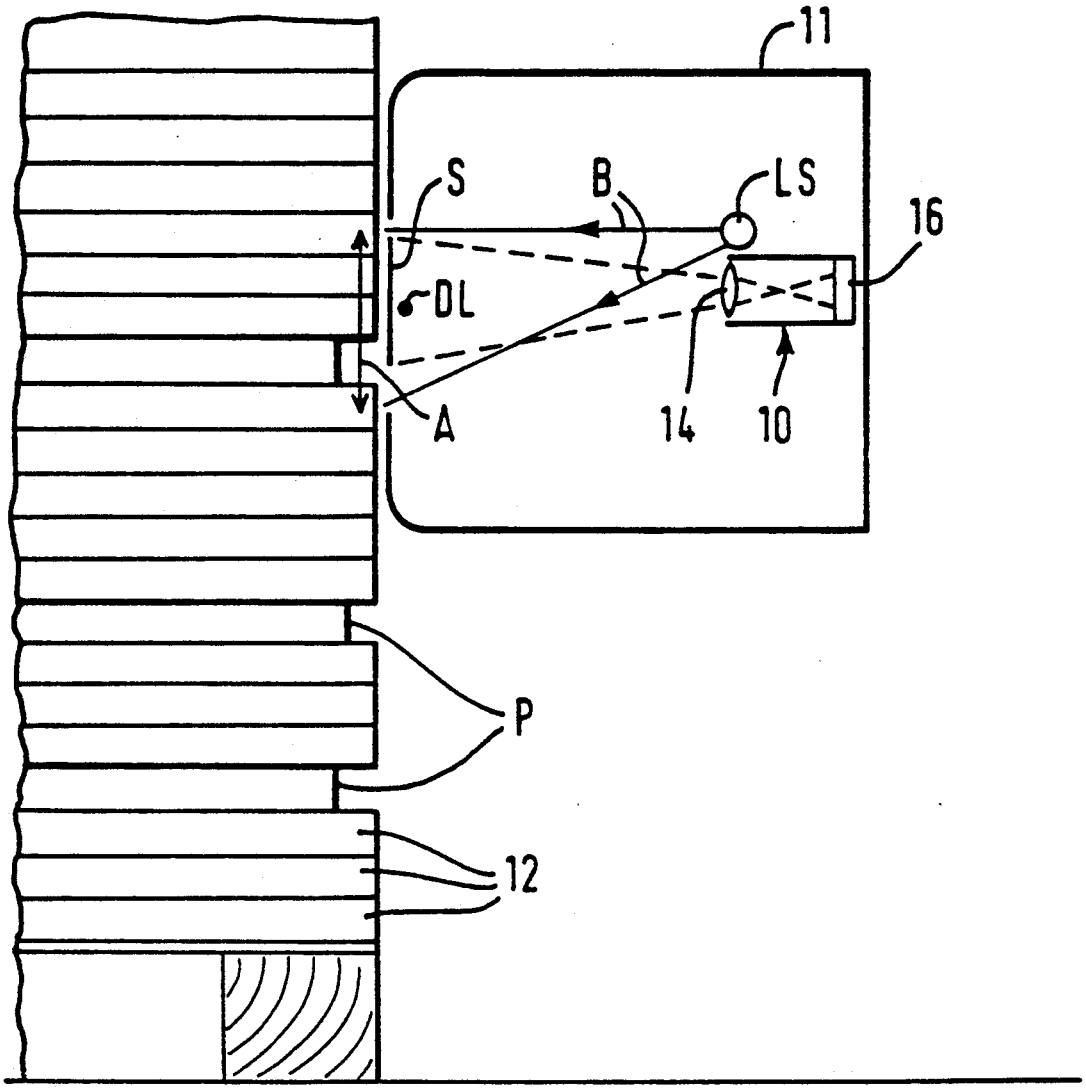
FIG. 1 is a diagrammatic side view of an instrument being used to count the number of panels in a stack.

Referring to FIG. 1 of the drawings, there is shown a hand-held instrument 10 being used to count the number of panels in a stack 12. The instrument 10 comprises an outer casing 11 for making rubbing contact with the side of the stack. The instrument also comprises a light source LS for directing a beam of light B onto the side of the stack so as to illuminate an area indicated at A. The instrument includes an optical system 14, shown for simplicity as a single lens, for receiving reflected light from the stack and projecting onto a linear photocell array 16 an image of a vertical strip S from the illuminated area A.

The instrument further comprises an electronic signal processing system for repeatedly scanning the photocell array 16, which preferably comprises a CCD (charge coupled device), in order to derive an electrical signal varying in accordance with the intensity of light reflected from the different points along the strip S of the side of the stack. In principle the intensity of light reflected from the side of the stack will vary in a periodic manner, the characteristic periodicity corresponding to successive panels in the stack. The electronic signal processing system is arranged to analyse the electrical signal derived from the photocell array 16 in order to determine the characteristic periodicity. This can be achieved even if certain irregularities occur in the expected periodic variations of the light reflected from the stack, for example due to occasional panels being inset from the side of the stack as indicated at P in FIG. 1.

Figure 2:
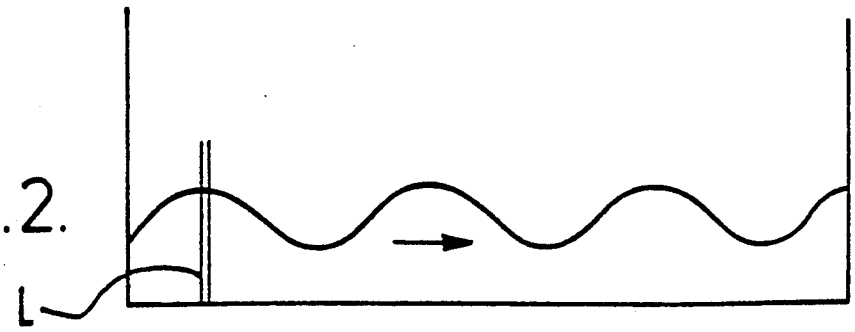
FIG. 2 is a waveform diagram for use in explaining the operation of the instrument.

By way of example and with reference to FIG. 2, a signal may be derived exhibiting the characteristic periodicity with each peak representing one of the panels in the vertical strip S of the stack. Then as the instrument 10 is moved say from the bottom to the top of the stack, the signal shown in FIG. 2 will effectively move e.g. from left to right. The signal processing system is arranged to count the number of peaks passing a fixed position L along the linear array, in order to provide a count of the number of panels in the stack.

Figure 3:
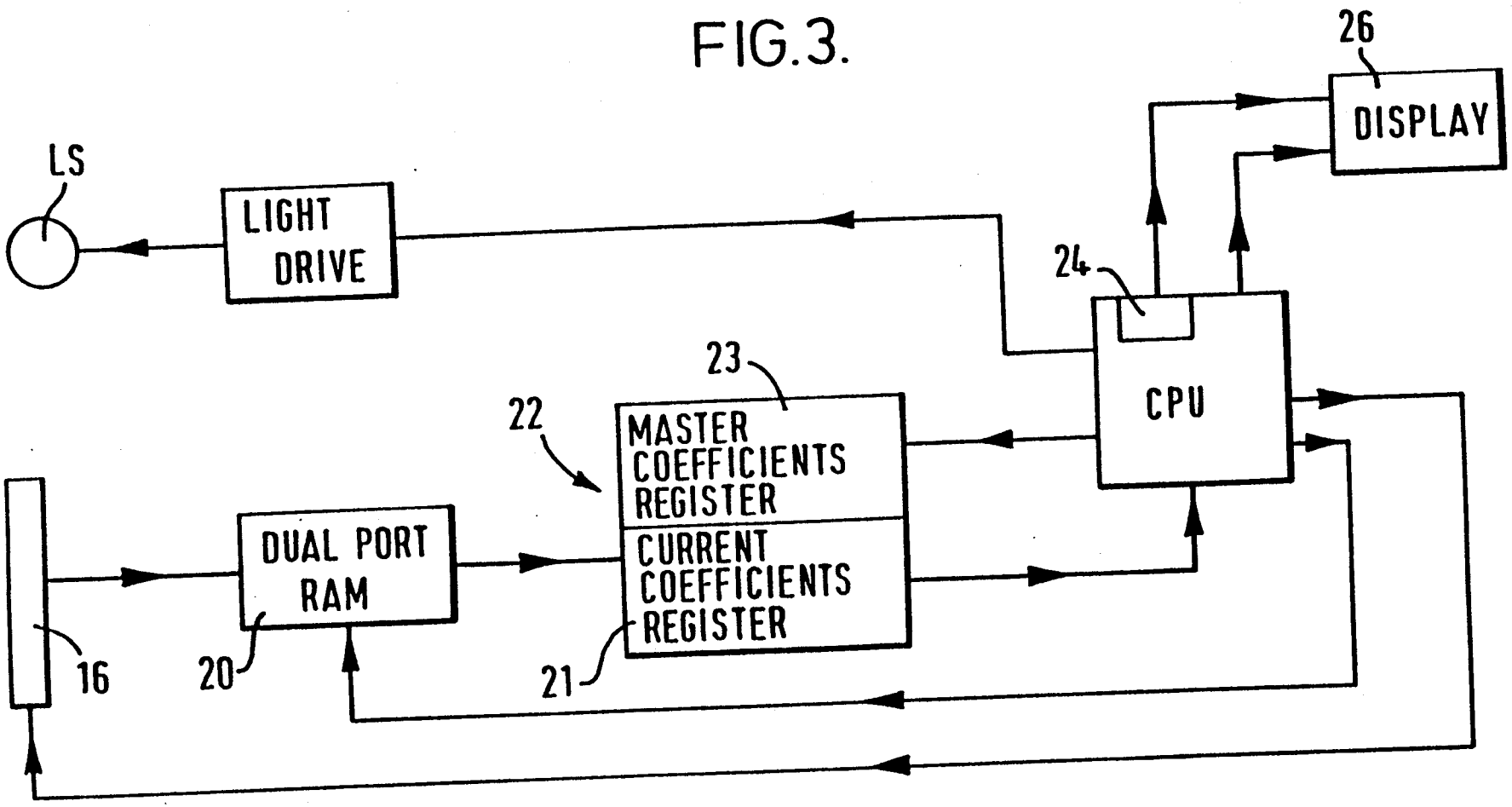
FIG. 3 is a schematic block diagram of a signal processing system of the instrument.

Referring to FIG. 3, the signal processing system comprises a microprocessor CPU for controlling the linear photocell array 16, which as mentioned before is preferably a CCD device. The output of the CCD device 16 is fed to a dual-port RAM (random access memory) 20, controlled by the microprocessor so that successive scans of the CCD device 16 are written into the RAM 20 via its two ports alternately. The microprocessor further reads out the successive scans from the RAM 20 to the current coefficients register 21 of a correlator device 22, which in the example shown comprises an IMS A100 device of Inmos Ltd, Bristol, England. The output of the correlator 22 is applied to the microprocessor CPU.

In operation, initially the instrument is held stationary against the side of the stack. The successive scans from the CCD 16 are applied via the RAM 20 to the correlator 22, and an auto-correlation function is carried out on the received scans. As a result of this operation, the microprocessor determines and loads a set of master coefficients into a master coefficient register 23 of the correlator 22. Then the instrument is ready to be moved up or down the stack, in rubbing contact therewith. During this movement, the successive scans from the CCD 16 are applied to the current coefficients register 21 of the correlator 22, and a cross-correlation function is carried out on the successive scans with the master coefficients in the master coefficient register 23 of the correlator. The output signal resulting from the correlator is a time varying signal with periodic peaks corresponding to the successive panels in the stack 12. From this time varying signal, the microprocessor may determine modified master coefficients and load these into the modified coefficients register: this modification may arise if the thickness of the panels in the stack varies (due for example to panels at the bottom of the stack being compressed by the weight of those above).

From the time varying signal received from the correlator 22, the microprocessor monitors the peaks moving past the fixed position L along the linear array and a counter 24 of the microprocessor counts these, to provide a count of the number of panels which the instrument has moved past. This count is given on a digital read-out or display 26. For example, the instrument may be directed at the foot of the stack initially, then moved to the top of the stack: the read out will then give the count of the total number of panels in the stack. The microprocessor determines the direction of passage of the successive peaks in the output signal, so that if the instrument is scanned in one direction (e.g upwardly of the stack) the counter increments, but if the instrument is scanned in the opposite direction (downwardly), the counter decrements.

The instrument shown is arranged to project a horizontal datum line DL on the side of the stack, so that the instrument may be used to count off a required number of panels from e.g. the top of the stack. The read-out provides information as to the number of panels counted off and the datum line provides an indication of the actual panel or position on the stack to which the count from the read-out relates.

The microprocessor is also able to determine the thickness of the panels in the stack and display this information on the read out 26. Thus the microprocessor is able to count the number of peaks in a segment of the time varying output from the correlator, which segment corresponds to one scan of the linear photocell array 16. In that the instrument is in rubbing contact with the side of the stack, from a knowledge of the fixed geometry of the optical system of the instrument the vertical height of the scanned portion S of the stack is known: and from this information and from the count of the number of peaks corresponding to one scan of the photocell array 16, the panel thickness is calculated.

Referring again to FIG. 3, advantageously the microprocessor applies a very short pulse to the light source LS, to increase its intensity of illumination for that duration, during the integration time of each scan of the CCD device, so that the movement of the instrument does not affect the quality of the image.

It will be appreciated that the instrument is simple and reliable to use and can be scanned by hand at any speed, which may be varied, over the side of the stack. There is no requirement to move the instrument at a constant speed, nor to know the speed of movement nor to know the thickness of the panels.

I claim:

1. An instrument for counting the number of elements in a stack, comprising means for scanning a side of the stack in a direction generally perpendicular to the edges of the element to provide an electrical signal, said means including a linear photocell array and an optical system for forming an image of a portion of the side of the stack onto the photocell array, said electrical signal being provided as a succession of electrical scan signals read out from said photocell array, and means for processing said electrical signal alone to determine a characteristic periodicity therein representing successive elements in the stack and for counting the repeating cycles in said electrical signal to provide a count of the number of elements in the stack, characterised in that the photocell array is disposed in the intended direction of scan and said characteristic periodicity which is determined and counted to provide said count of the number of elements in the stack is a characteristic periodicity in each scan signal.

2. An instrument as claimed in claim 1, in which said electrical scan signals from said photocell array are fed to a correlator device.

3. An instrument as claimed in claim 2, in which said correlator is arranged to carry out an initial auto-correlation function on each received scan signal to determine a set of master coefficients.

4. An instrument as claimed in claim 3, in which said correlator is arranged to carry out subsequently a cross-correlation function on each scan signal with the set of master coefficients to produce a time varying signal with said characteristic periodicity representing successive elements in the stack.

5. An instrument as claimed in claim 1, further comprising means to provide an incrementing count when moved in one direction relative to the stack, and a decrementing count when moved in the opposite direction.

6. An instrument as claimed in claim 1, further comprising means to determine the thickness of the panels in stack.

* * * * *